US008428505B2

(12) United States Patent
Udagawa

(10) Patent No.: US 8,428,505 B2
(45) Date of Patent: Apr. 23, 2013

(54) IMAGE FORMING APPARATUS

(75) Inventor: Hiroshi Udagawa, Minato-ku (JP)

(73) Assignee: Oki Data Corporation, Tokyo (JP)

( * ) Notice: Subject to any disclaimer, the term of this patent is extended or adjusted under 35 U.S.C. 154(b) by 1195 days.

(21) Appl. No.: 12/235,896

(22) Filed: Sep. 23, 2008

(65) Prior Publication Data

US 2009/0087203 A1 Apr. 2, 2009

(30) Foreign Application Priority Data

Sep. 27, 2007 (JP) ..... 2007-250959

(51) Int. Cl.
*G03G 15/00* (2006.01)

(52) U.S. Cl.
USPC ..... 399/388; 399/301

(58) Field of Classification Search ..... 399/388, 399/301
See application file for complete search history.

(56) References Cited

U.S. PATENT DOCUMENTS

| | | | | |
|---|---|---|---|---|
| 4,690,542 | A | 9/1987 | Furuta et al. | |
| 5,842,095 | A * | 11/1998 | Kitamura | 399/299 |
| 5,974,282 | A | 10/1999 | Yamada | |
| 6,029,023 | A | 2/2000 | Munemori et al. | |
| 6,571,078 | B2 * | 5/2003 | Munemori et al. | 399/298 |
| 2005/0068402 | A1 * | 3/2005 | Tsujino et al. | 347/112 |
| 2007/0025768 | A1 * | 2/2007 | Komatsu et al. | 399/167 |
| 2007/0110464 | A1 * | 5/2007 | Nakayama et al. | 399/45 |
| 2008/0025744 | A1 * | 1/2008 | Miyamoto et al. | 399/66 |

FOREIGN PATENT DOCUMENTS

| | | | |
|---|---|---|---|
| JP | 57004062 A | * | 1/1982 |
| JP | 63311360 A | | 12/1988 |
| JP | 5333662 A | | 12/1993 |
| JP | 07-013471 A | | 1/1995 |
| JP | 09090779 A | * | 4/1997 |
| JP | 09325560 A | * | 12/1997 |
| JP | 11084898 A | | 3/1999 |
| JP | 11218979 A | * | 8/1999 |
| JP | 2003076073 A | * | 3/2003 |
| JP | 2003091131 A | * | 3/2003 |
| JP | 2004004398 A | * | 1/2004 |
| JP | 2005-200133 A | | 7/2005 |

(Continued)

OTHER PUBLICATIONS

Machine Translation of JP 2007193000 A, JPO, Sep. 23, 2011.*
Japanese Office Action for the related Japanese Application No. 2007-250959 mailed Sep. 1, 2009.

*Primary Examiner* — Matthew G Marini
*Assistant Examiner* — Nguyen Q Ha
(74) *Attorney, Agent, or Firm* — Panitch Schwarze Belisario & Nadel LLP

(57) ABSTRACT

A controller controls transportation of the recording medium such that a first distance between a trailing edge of an image area of a preceding page of the two successive pages and a leading edge of an image area of a following page is equal to or longer than a second distance between the nip at a most upstream one of the image forming sections and the nip at a most downstream one of the image forming sections. Control may also be performed such that a first distance between a trailing edge of a preceding page of the two successive pages and a leading edge of a following page is equal to or longer than a second distance between the nip at a most upstream one of the plurality of image forming sections and the nip at a most downstream one of the plurality of image forming sections.

20 Claims, 12 Drawing Sheets

FOREIGN PATENT DOCUMENTS

| | | | | |
|---|---|---|---|---|
| JP | 2006-208458 | A | | 8/2006 |
| JP | 2006259483 | A | * | 9/2006 |
| JP | 2007193000 | A | * | 8/2007 |

* cited by examiner

PRIOR ART

IMAGE FORMING APPARATUS

BACKGROUND OF THE INVENTION

1. Field of the Invention

The present invention relates generally to an image forming apparatus that prints an image on a recording medium.

2. Description of the Related Art

A conventional image forming apparatus such as a copying machine, a printer, or a facsimile machine employs an electrophotographic process. A charging device uniformly charges the surface of a photoconductive body. An exposing device such as a laser scanner or an LED head illuminates the charged surface to write an electrostatic latent image on the photoconductive body. A developing device supplies toner to the electrostatic latent image to form a toner image. The toner image is transferred onto a recording medium such as paper or a film directly or indirectly via an intermediate transfer system. The recording medium is then advanced to a fixing device where the toner image is fused to the recording medium.

The image forming apparatus includes a feed roller that feeds sheets of paper from a paper cassette into a transport path, a pair of registry rollers disposed downstream of the feed roller, and a paper sensor disposed downstream of the registry rollers at a widthwise mid point of the transport path. The recording medium is transported on a sheet-by-sheet basis. When continuous printing is performed, a following sheet of two consecutive sheets is fed a predetermined amount of time after the trailing end of a preceding sheet is detected by the sensor.

More than one sheet of recording medium may be on the transfer belt simultaneously in continuous printing. It is desirable that the gap between successive sheets (i.e., interpage gap or interpage distance) is constant. However, the transfer belt may not run at the same speed as the paper transporting mechanism, in which case, the interpage gap may not be always constant. This is particularly true if the recording medium is thick and rigid so that the recording medium is difficult to flex and moves relative to the transfer belt. This causes positional errors of the recording medium and therefore color shift in a printed image.

SUMMARY OF THE INVENTION

The present invention was made in view of the aforementioned drawbacks.

An object of the present invention is to provide an image forming apparatus in which color shift is minimized even when printing is performed on a thick, rigid recording medium.

A controller controls transportation of the recording medium such that a first distance between a trailing edge of an image area of a preceding page of the two successive pages and a leading edge of an image area of a following page is equal to or longer than a second distance between the nip at a most upstream one of the image forming sections and the nip at a most downstream one of the image forming sections. Control may also be performed such that a first distance between a trailing edge of a preceding page of the two successive pages and a leading edge of a following page is equal to or longer than a second distance between the nip at a most upstream one of the plurality of image forming sections and the nip at a most downstream one of the plurality of image forming sections.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

An image forming apparatus of the invention will be described in detail with reference to the accompanying drawings. The invention is not limited to the following embodiments, and modifications may be made without departing the scope of the invention.

As described in the following embodiments, if a print medium is of a predetermined type, the interpage distance is selected such that $L_D > L_{all}$ or $L_F > L_{all}$. If a print medium has a thickness larger than a predetermined value, the interpage distance is selected to be such that $L_D > L_{all}$ or $L_F > L_{all}$. Thus, image forming apparatus of the invention may be applicable to a variety of types of print medium including paper, OHP (transparency), and thick print medium. In fact, the interpage distance may be selected such that $L_D > L_{all}$ or $L_F > L_{all}$, depending not only on the thickness but also on the type of print medium (e.g., paper and OHP sheet).

First Embodiment

Figure 1:
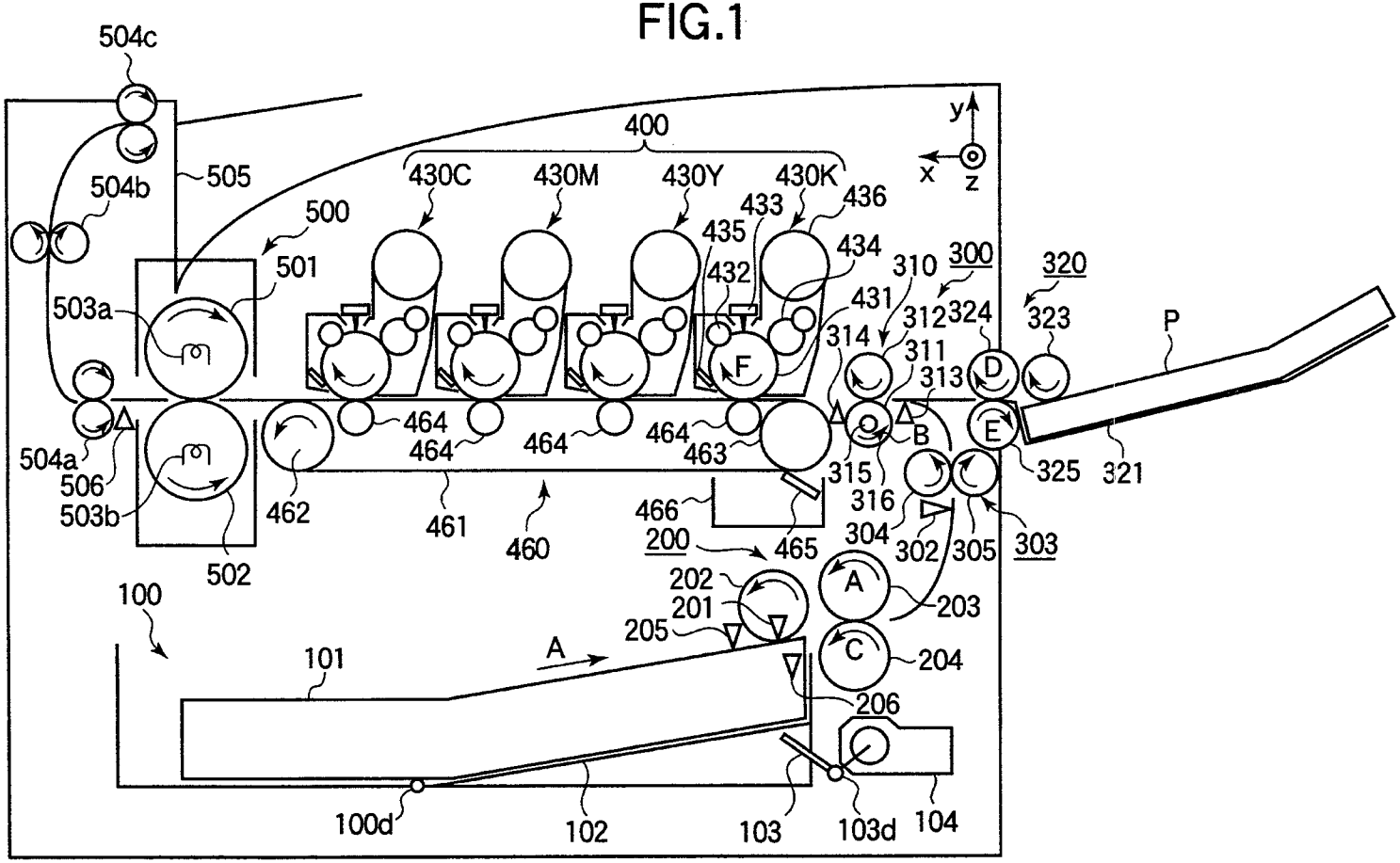
FIG. 1 illustrates the configuration of an image forming apparatus of the invention.

FIG. 1 illustrates the configuration of an image forming apparatus of the invention. The image forming apparatus includes a paper tray 100, a paper feeding section 200, a paper transporting section 300, a multi purpose tray (MPT) 320, a color image forming section 400, a transfer section 460, and a fixing section 500.

The paper tray 100 is a rectangular, and includes a platform 102 disposed at its bottom. The paper tray 100 is detachably attached to the image forming apparatus, and holds a stack of recording medium such as paper 101 or OHP sheet (i.e., transparencies). The platform 102 is pivotally mounted to a shaft 100*d*. A lift-up lever 103 is disposed at an exit of the paper tray 100, and is pivotal about a shaft 103*d*. When the paper tray 100 is attached to the image forming apparatus, the shaft 103*d* is detachably coupled to a motor 104. The motor 104 drives the shaft 103*d* in rotation so that the lift-up lever 103 pivots about the shaft 100*d* upward. As a result, a stack of the paper 101 on the plat platform 102 is raised upward. Once the top of the stack of the paper 101 has reached to a predetermined height, the paper 101 is ready to be fed out of the paper tray 100 by the paper feeding section 200 on a sheet-by-sheet basis.

The paper feeding section 200 includes a height sensor 201, a pick-up roller 202, a feed roller 203, and a retard roller 204. The height sensor 201 and pick-up roller 202 are disposed over the paper tray 100. The feed roller 203 and retard roller 204 are in contact with each other, and are disposed downstream of the pick-up roller 202 with respect to travel of the paper 101. When the stack of the paper 101 placed on the platform 102 is raised by the lift-up lever 103, the height sensor 201 detects the upward movement of the stack of paper 101. The motor 104 stops rotating in response to the detection output of the height sensor 201. At this moment, the pick up roller 202 abuts the top sheet of the stack of the paper 101. A feed motor 607, which will be described later, drives the pick-up roller 202 and feed roller 203 to rotate in directions shown by arrows A and C, respectively. When the pick-up roller 202 rotates, the pick-up roller 202 causes the top sheet of the stack of the paper 101 to advance to the feed roller 203, which in turn cooperates with the retard roller 204 to advance only a sheet at a time to the paper transporting section 300.

The paper transporting section 300 is disposed downstream of the paper feeding section 200, and includes a paper sensor 302, a transport roller pair 303, a paper sensor 313, a transport roller pair 310, and a write sensor 314, which are disposed in this order along the transport path. The transport roller pair 303 includes a drive roller 304 and a driven roller 305. The drive roller 304 is driven by a drive source (not shown) to transport the paper 101. The driven roller 305 rotates freely in pressure contact with the drive roller 304. The paper 101 is pulled in between the drive roller 304 and driven roller 305, and is then advanced a predetermined amount of time after the paper 101 passes the leading edge of the paper sensor 302. When the paper 101 abuts a nip formed between the drive roller 304 and driven roller 305, the skew of the paper 101 is corrected.

The transport roller pair 310 includes a drive roller 311 and a driven roller 312. The drive roller 311 includes a shaft 315 covered with a friction material 316 such as rubber. A drive source (not shown) drives the shaft 315 to rotate in a direction shown by arrow B. A driven roller 312 is in pressure contact with the drive roller 311, and is freely rotatable. When the leading edge of the paper 101 passes a paper sensor 313, the transport roller pair 310 is driven into rotation so that the paper 102 is transported without stopping. The paper 101 then passes the write sensor 314 and then enters the color image forming section 400.

Paper may be fed from the MPT 320 as well as from the paper tray 100. The MPT 320 is attached to the outer periphery of the image forming apparatus. The MPT 320 is a paper feeding mechanism that transports paper P placed on a platform 321 pivotally supported by a shaft (not shown). A spring (not shown) urges the platform 321 upward to raise the stack of the paper P. An MPT roller 324 and a retard roller 325 are in pressure contact with each other, and are disposed downstream of the pick-up roller 323. When the paper P has been raised to a certain height, the top sheet of the stack of paper P abuts the pick-up roller 323. The feed motor 607, which will be described later, drives the pick-up roller 323 and MPT roller 324 to rotate in directions shown by arrows D and E, respectively. When the pick-up roller 323 rotates, the pick-up roller 323 causes the top sheet of the paper 101 to advance to the MPT roller 324, which in turn cooperates with the retard roller 325 to advance only a sheet at a time to the paper transporting section 300.

The paper 101 is pulled in between the drive roller 311 and driven roller 312, and is then advanced a predetermined amount of time after the leading edge of the paper 101 has passed the paper sensor 313. When the paper 101 abuts a nip formed between the drive roller 311 and driven roller 312, the skew of the paper 101 is corrected.

The color image forming section 400 includes process units 430K, 430Y, 430M, and 430C that are aligned from upstream to downstream with respect to travel of the paper 101. The process unit 430K holds black toner and forms a black toner image. The process unit 430Y holds yellow toner and forms a yellow toner image. The process unit 430M holds magenta toner and forms a magenta toner image. The process unit 430C holds cyan toner and forms a cyan toner image. Each of the toner process units 430K-430C may be substantially identical; for simplicity only the operation of the process unit 430K for forming black images will be described, it being understood that the other process units may work in a similar fashion.

The process unit 430K includes a photoconductive drum 431, a charging roller 432, an exposing device 433, a developing roller 434, a cleaning blade 43, and a toner reservoir 436. The photoconductive drum 431 rotates in a direction shown by arrow F. The charging roller 432 rotates in contact with the photoconductive drum 431 and uniformly charges the circumferential surface of the photoconductive drum 43. The exposing device 433 illuminates the charged surface of the photoconductive drum 431 to form an electrostatic latent image. The developing roller 434 rotates in contact with the photoconductive drum 431 to supply toner, received from the toner reservoir, to the electrostatic latent image, thereby forming a toner image on the photoconductive drum 431. The cleaning blade 435 removes residual toner from the photoconductive drum 431 after transfer of the toner image onto the paper 101. The drum and rollers are driven by an ID motor 610 which will be described later.

The transfer section 460 includes a transfer belt 461 disposed about a drive roller 462 and a tension roller 463, the transfer belt 461 running through the respective process units while electrostatically attracting the paper 101 or P thereto. The transfer belt 461 is sandwiched between the photoconductive drums 431 and transfer rollers 464. A cleaning blade 465 is disposed under the transfer belt 461 to scrape residual toner off the transfer belt 461. A toner box 466 is disposed under the cleaning blade 465 and collects the residual toner therein. When the paper 101 or P is fed to the process unit, a transfer bias is applied to the transfer rollers 464, thereby transferring the toner images of respective colors one over the other in registration onto the paper 101. After transfer of the toner images, the paper 101 is advanced to the fixing device 500. The drive roller 462 is driven in rotation by a belt motor 609, which will be described later, through, for example, a gear train. If the transport roller pair 310 is configured to rotate such that the circumferential speed of the transport roller pair 310 is equal to the linear speed of the transfer belt 461, the transfer belt 461 may run at a higher speed than the designed speed due to variations in the diameters of the drive roller 462, tension roller 463, drive roller 311, and driven roller 312. If the transfer belt 461 runs at a higher speed than the designed speed, the paper 101 or P is in tension between the transport roller pair 310 and the transfer section 460. As a result, the transport speed of the paper 101 or P at the transfer belt 461 is higher than that at the transport roller pair 310.

The fixing device 500 includes an upper roller 501 and a lower roller 502 both of which incorporate a halogen lamp as a heat source. The upper roller 501 and lower roller 502 have a roller surface formed of a resilient material, and cooperate with each other to hold the paper 101 or P therebetween in sandwiched relation. The upper roller 501 and lower roller 502 rotate to fuse the toner image to the paper 101 or P to form a permanent image. Then, the paper 101 or P is discharged by discharge roller pairs 504*a*, 504*b*, and 504*c* downstream of the fixing device 500 onto a stacker 505. The upper roller 501 and lower roller 502 are driven in rotation by the fixing motor 611 via, for example, a gear train.

Figure 2:
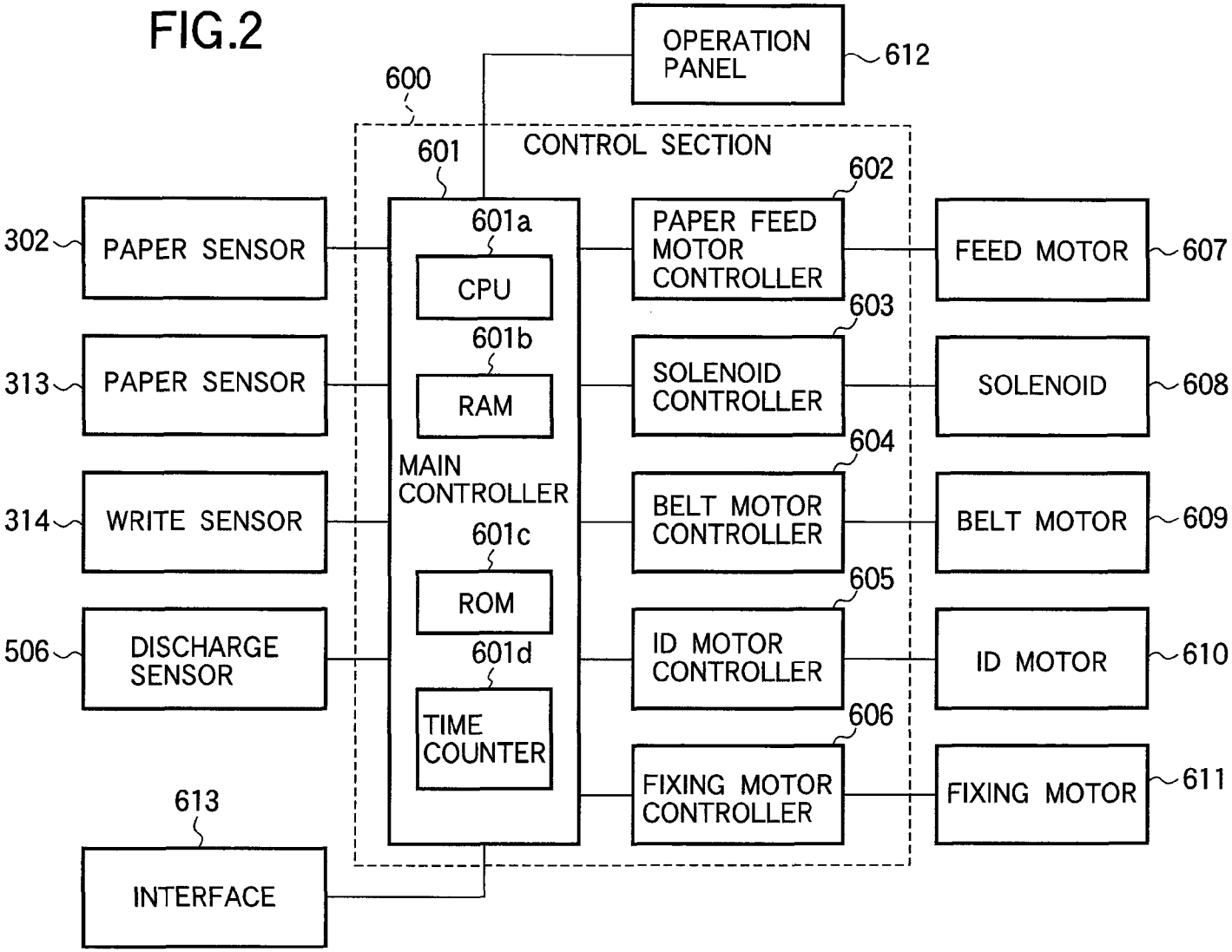
FIG. 2 is a block diagram illustrating a control section of the image forming apparatus of a first embodiment.

FIG. 2 is a block diagram illustrating a control section 600 of an image forming apparatus of the first embodiment. The control section 600 includes a main controller 601, a paper feed motor controller 602, a solenoid controller 603, a belt motor controller 604, an ID motor controller 605, and a fixing motor controller 606.

The paper feed motor controller 602, belt motor controller 604, ID motor controller 605, and fixing motor controller 606 provide operation signals to a solenoid 608, a belt motor 609, ID motor 610, and fixing motor 611, respectively, to control their operations. The main controller 601 incorporates a central processing unit (CPU) 601*a*, a random access memory (RAM) 601*b*, a read only memory (ROM), and a time counter 601*d*. In response to the detection signals from the various sensors received through an input port, the main controller 601 controls the paper feed motor controller 602, solenoid controller 603, belt motor controller 604, ID motor controller 605, and fixing motor controller 606, thereby activating and controlling corresponding sections.

These motors may take the form of, for example, a two-phase pulse motor or a DC motor. A two-phase pulse motor is such that a predetermined amount of current is supplied to each motor. The direction of phase current is switched on the rising edge of clocks and the rotation of the motor is accelerated and decelerated by changing the clock frequency. A DC motor is such that the voltage applied across motor terminals is changed to control the rotational speed and the polarity of the voltage is switched to change the rotational direction.

The solenoid may take the form of a DC solenoid. ADC solenoid is such that current is supplied in the coil wound around a fixed core to generate an amount of magnetic flux that attracts a movable core within a predetermined stroke until the movable core moves into intimate contact with the fixed core. When the solenoid is energized, the movement of the movable core causes a mechanical motion of an external mechanism coupled to the movable core. Continuously energizing the solenoid maintains the movable core in intimate contact with the fixed core. De-energizing the solenoid allows the movable core to move back to its original position with the aid of a return spring. The solenoid is effectively used to cause gears to move into meshing engagement with one another.

The main controller 601 is connected to an operation panel 612 of the image forming apparatus. The operation panel 612 includes an input section configured with switches (not shown) and a display section configured with light emitting diodes (LEDs) or a liquid crystal display (LCD). The operation panel 612 is an interface through which a user is allowed to operate the input section to select various settings such as the type of medium (paper, transparency, thickness) and font. The selected settings are displayed on the display section.

The main controller 601 is also connected to an interface section 613. The interface section 613 includes an interface connector and interface ICs (not shown), receives print data from a host computer (not shown), and sends the print data to the main controller 601.

When the feed motor 607 rotates in a forward direction, the feed roller 203 and transport rollers 303 and 310 are coupled to a planetary gear train (not shown) so that a drive force is transmitted. When the feed motor 607 rotates in a reverse direction, the planetary gear assembly rotates in a reverse direction so that the MPT roller 324 is coupled to another gear train (not shown) through which a drive force is transmitted to the MPT roller 324.

{Continuous Printing}

Figure 3:
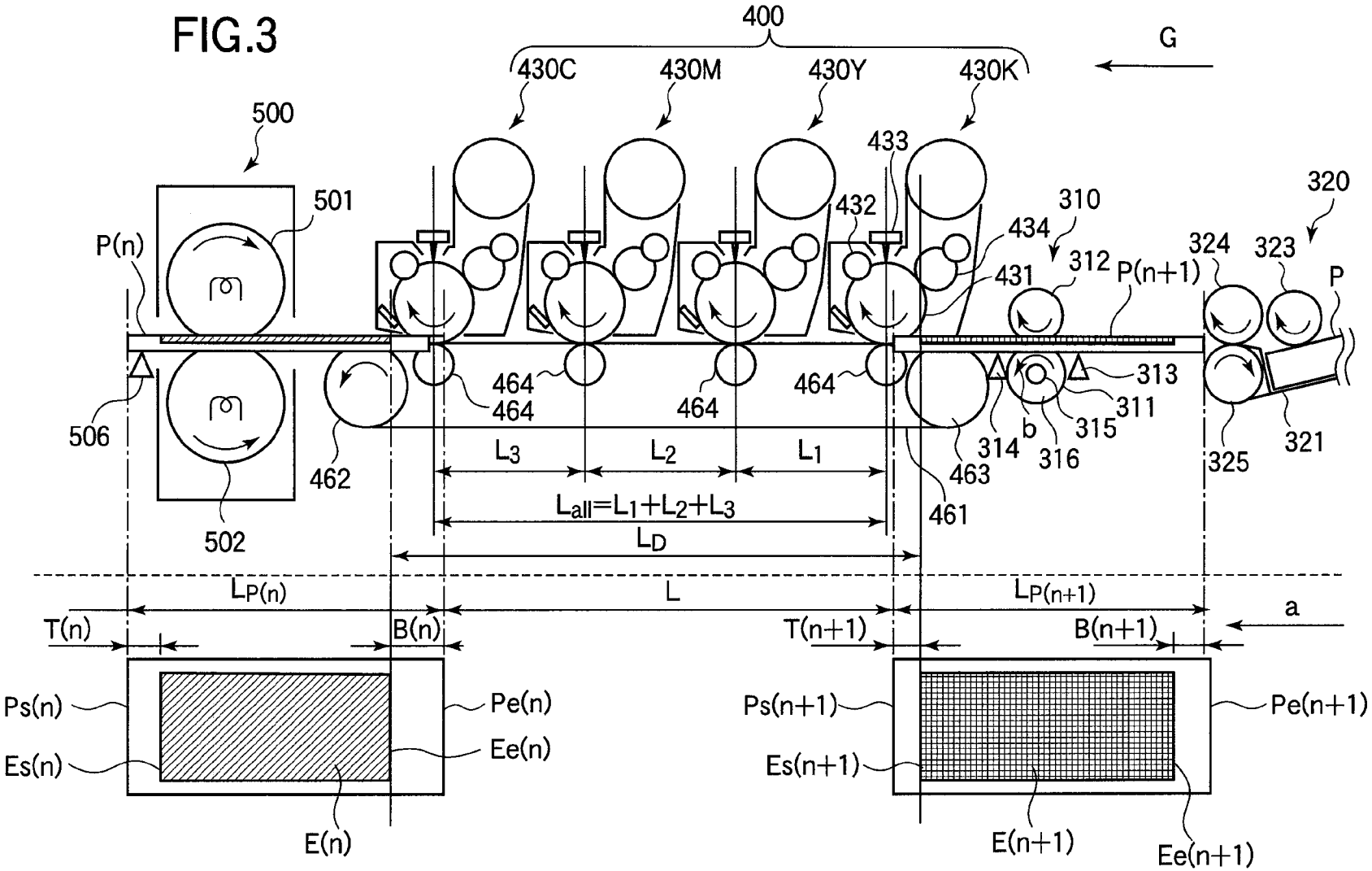
FIG. 3 illustrates the continuous printing operation of the image forming apparatus.

The continuous printing operation of the image forming apparatus will be described. FIG. 3 illustrates the continuous printing operation of the image forming apparatus.

Various parameters will be described with reference to FIG. 3. P(n) indicates the nth page in continuous printing. Ps(n) is a leading edge of P(n). Pe(n) is the trailing edge of the paper P(n). Lp(n) is a length of the paper P(n) in a direction in which the paper is transported, and is a distance from Ps(n) to Pe(n). E(n) is an image area on the paper P(n). Es(n) is the leading edge of the image area E(n). An image is formed, beginning from the leading edge Es(n). Ee(n) is the trailing edge of the image area E(n). The image ends at Ee(n). T(n) is a distance from Ps(n) to Es(n). B(n) is a distance from Pe(n) to Ee(n).

P(n+1) indicates the (n+1) th page in the continuous printing. Ps(n+1) is the leading edge of P(n+1). Pe(n+1) is a trailing edge of P(n+1). E(n+1) is an image area on P(n+1). Lp(n+1) is a length of P(n+1) in a direction in which the paper P is transported, and is a distance from Ps(n+1) to Pe(n+1). Es(n+1) is an image area on P(n+1). Es(n+1) is the leading edge of the image area E(n+1). An image is formed on P(n+1), beginning from Es(n+1). Ee(n+1) is the trailing edge of the image area E(n+1). The image ends at Ee(n+1). T(n+1) is a distance from Ps(n+1) to Es(n+1). B(n+1) is a distance from Pe(n+1) to Ee(n+1).

L is the distance between the paper P(n) and the paper P(n+1), i.e., the distance from Pe(n) to Ps(n+1). $L_D$ is the distance between image areas of P(n) and (Pn+1), i.e., between Ee(n) and Es(n+1).

The positions of the respective process units 430K, 430Y, 430M, and 460C are defined to be a location of a nip between a corresponding photoconductive drum 431 and a corresponding transfer roller 464. Thus, the distance between adjacent process units is the distance between the nips of the adjacent units. The distance between the process units 430K and 430Y is L1. The distance between the process units 430Y and 430M is L2. The distance between the process units 430M and 430C is L3. The distance between the process units 430K and 430C is $L_{all}$, which is equal to L1+L2+L3.

When continuous printing is performed on more than two consecutive pages, pages are advanced from the MPT 320 or the paper tray 100 such that the nth page p(n) and the (n+1) th page P(n+1) are spaced apart by the distance L. If the continuous printing is performed on paper having a thickness greater than a predetermined value, the pages are transported with an interpage distance longer than the distance between adjacent nips, i.e., $L_D > L_{all}$. If the basic weight of the paper is 120 g/m$^2$, the interpage distance L is given by Equation (1) as follows.

$$L_D > L_{all} = L1 + L2 + L3$$

$$L = L_D - \{B(n) + T(n+1)\}$$

$$L > (L1 + L2 + L3) - \{B(n) + T(n+1)\} \quad (1)$$

In other words, the paper is transported such that the distance $L_D$ between Ee(n) and Es(n+1) is longer than $L_{all}$. However, for simplicity, the first embodiment will be described in terms of the interpage distance L obtained from Equation (1).

Equation (1) indicates that an image area only of one page is present in a region shown by a distance $L_{all}$ immediately downstream of the nip formed between the process unit 430K and a transfer point in a direction shown by arrow G.

{Non-Continuous Printing}

The operation of the image forming apparatus will be described. The paper P is fed by the MPT 320 and transport roller pair 310 to the image forming section 400. The paper P is then transported further while being sandwiched in the nip areas between the process units 430K and 430Y and the transfer section 460. At this moment, the trailing portion of the paper P is sandwiched by the transport roller pair 310.

The transport roller pair 310 includes springs (not shown) mounted to both longitudinal end portions of a rotational shaft of the driven roller 312, the springs urging the driven roller 312 against the friction roller 316 to develop a sufficient transporting force required for transporting the paper P. This force is larger than the transporting force developed at the nip area between the process unit 430K and the transfer section 460. This implies that the transport speed of the paper P is more dependent on the change in the speed of the transport roller pair 310. The paper P is further transported so that the leading edge Ps of the paper P reaches the nip formed between the process unit 430M and the transfer section 460. It is to be noted that the paper P is electrostatically attracted to the transfer belt 461 and advances along the transport path, while being sandwiched by the transport roller pair 310, the nip formed between the process unit 430K and the transfer section 460, the nip formed between the process unit 430Y and the transfer section 460, and the nip formed between the process unit 430M and the transfer section 460.

At this moment, the transporting force exerted on the paper P by the image forming section 400 overcomes the transporting force exerted by the transport roller pair 310 on the paper P. Thus, the transport speed of the paper P is more dependent on the changes in the speed of the image forming section 400. The paper P is further advanced so that the trailing edge Pe of the paper P leaves the transport roller pair 310. Thereafter, the paper P is transported only by the image forming section 400. In this manner, as the paper P advances through the image forming section 400, the paper P is sandwiched by an increasing number of nips and is attracted to the transfer belt 461 through an increasing area. The paper P is still further advanced, the leading edge Ps of the paper P reaching the fixing section 500 and then being pulled in between the upper roller 501 and the lower roller 502. From this point of time, as the paper P advances through the image forming section 400, the paper P is sandwiched by a decreasing number of nips and is attracted to the transfer belt 461 through a decreasing area. Thus, the transport speed of the paper P becomes more dependent on the speed of the fixing section 500 than on the speed of the image forming section 400.

The change in the speed of the paper transporting mechanism varies gradually and therefore no significant color shift occurs in the image printed on the paper P. The speed of the paper transporting mechanism is corrected such that the speeds of the transport roller pair 310 and the upper and lower rollers 501 and 502 in the fixing section 500 are within predetermined ranges of change, thereby forming high definition images with less color shift.

The operation of the image forming apparatus and associated paper behavior during continuous printing will be described.

A first page P(1) is transported to the image forming section for printing an image on the paper P(1).

When the first page P(1) advances past the write sensor 314, the write sensor 314 detects the leading edge Ps(1), and provides a sensor ON signal to the main controller 601.

After the write sensor 314 has detected the leading edge Ps(1) the paper P(1) is further advanced. Then, the write sensor 314 detects the trailing edge Pe(1) of the paper P(1), providing a sensor OFF signal to the main controller 601. Then, a drive source (not shown) stops driving the transport roller pair 310.

Thereafter, the MPT 320 feeds a second page P(2) to the transport roller pair 310, and the write sensor 314 detects the leading edge Ps(2) of the second page P(2). The page P(2) is further advanced a predetermined distance after the write sensor 314 has detected the leading edge Ps(2), and then the drive source (not shown) stops driving the MPT 320. The paper P(2) abuts the nip of the transport roller pair 310 for correction of skew. When the trailing edge of the page P(1) has advanced the distance L past the write sensor 314, the transport roller pair 310 is driven into rotation to initiate transportation of the page P(2).

The time counter 601*d* of the main controller 601 starts to count in response to the sensor OFF signal. Then, after a predetermined time elapsed, the main controller 601 determines that the page P(1) has advanced over the distance L. The predetermined time is determined by taking into consideration the transport speed of the paper during image formation, an amount of time for the paper having a specific size to pass the write sensor 314, slippage of the paper when the paper is transported by the paper transporting mechanism, and an amount of delay time for mechanical components (not shown) to engage each other.

A specific example of transportation of A4 size paper will be described. The distance L is L>180−(10+10)=160 mm, where the distance L1+L2+L3 is 180 mm, B(1) is 10 mm, and T(2) is 10 mm. If the distance L is to be set L=(L1+L2+L3)−{B(1)+T(2)}+5 mm, then L is set to L=165 mm. If the transport speed of the transport roller pair 310 is set to 70 mm/sec, then the time required for the page P(1) to be advanced over a distance of 165 mm is 2.36 sec. Taking into consideration the slippage of the paper in the transport roller pair 310 and the time required for the write sensor 314 to return from the ON state to the OFF state, the delay time is assumed to be 0.06 sec. When the pages P(1) and P(2) are transported, if the trailing edge of the page P(1) causes the write sensor 314 to return from the ON state to the OFF state, the time counter 601*d* starts to count upon the transition from the ON state to the OFF state, so that the transport roller pair 310 starts to transport the page P(2) after a time 2.36−0.06=2.3 sec.

Once the page P(2) starts to be transported, the page P(2) is subjected to transportation and image formation just as in the page P(1). For continuous printing, pages are also transported such that page P(n−1) and page P(n) are spaced apart by the distance L and page P(n) and Page P(n+1) are also spaced apart by the distance L, satisfying Equation (1).

The interface 613 shown in FIG. 2 receives the print data from a host computer (not shown). The main controller 601 receives information (i.e., B(n) and T(n)) on the image area contained in the print data. Then, based on the B(n) and T(n), the main controller 601 calculates the time required for transporting the P(n) and the transport speed for transporting the P(n). Upon receiving a signal indicative that the leading edge Ps(n) has reached the write sensor 314, the main controller 601 allows P(n) to advance for a predetermined amount of time during which the P(n) advances to the nip formed between the process unit 430K and the transfer section 460. Then, the main controller 601 performs image formation on the P(n) based on the print data. Upon receiving a signal indicative that the trailing edge of P(n) has left the write sensor 314, the main controller 601 determines that the E(n) of the P(n) has passed the write sensor 314 a certain amount of time ago. The certain amount of time is the time required for the leading edge of P(n) to advance over the distance T(n) after the trailing edge Pe(n) has left the write sensor 314. By using the timer counter 601*d*, the main controller 601 determines the time required for P(n) to advance over a distance based on the time at which the output of the write sensor 314 becomes ON or OFF, thereby controlling the interpage distance.

The operation for controlling the image forming apparatus will be described.

Figure 4:
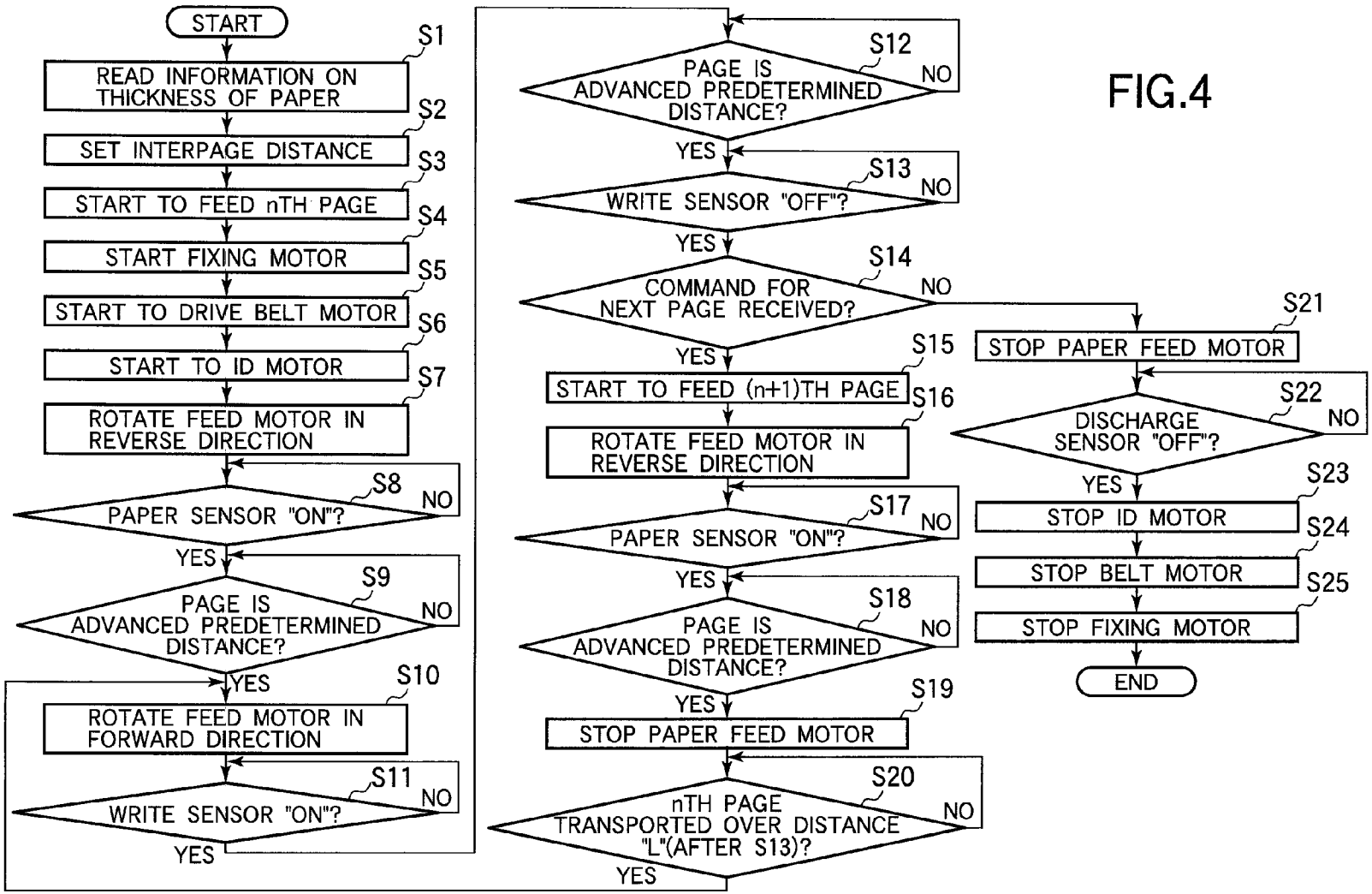
FIG. 4 is a flowchart illustrating the control of the image forming apparatus when paper is fed from a multi purpose tray.

FIG. 4 is a flowchart illustrating the control of the image forming apparatus when the paper is fed from the MPT 320. If the discharge sensor 506 fails to detect the leading edge or the trailing edge of the paper at steps S1-S25, it is determined that the abnormal transportation of the paper has occurred.

The main controller 601 reads information on the settings of the paper such as the basic weight and thickness of paper, inputted by the user from the operation panel 612 (step S1). If the thickness of paper is larger than a predetermined value, the main controller 601 controls interpage distance (step S2). The main controller 601 sends commands to the paper feed motor controller 602, belt motor controller 604, ID motor controller 605, and fixing motor controller 606 (step S3). The fixing motor controller 606 starts to drive the upper roller 501 and lower roller 502 in rotation (step S4). Then, the main controller 601 controls the belt motor 609 to drive the drive roller 462 (step S5), controls the ID motor 610 to drive the photoconductive drums 431 of the process units 430*k* to 430C (step S6). Further, the main controller 611 controls the paper feed motor 607 to rotate in the reverse direction so that the P(1) is fed from the MPT 320 (step S7).

When the paper sensor 313 detects the leading edge Ps(1), the MPT roller 324 causes the page P(1) to advance a predetermined distance toward the nip formed between the friction member 316 and the driven roller 312. Thus, the page P(2) advances a predetermined distance after the page P(1) abuts the nip (step S9) for correcting the skew of the page P(1). The main controller 601 sends a command to the paper feed motor controller 602, causing the paper feed motor 607 to rotate in the forward direction so that the transport roller pair 310 rotates (step S10) to advance the page P(1) to the image forming section 400.

The page P(1) is advanced by the transport roller pair 310, and the write sensor 314 detects the leading edge of the page P(1) (step S11). The page P(1) is transported by the transport roller pair 310, transfer belt 461, photoconductive drums 431 and corresponding transfer rollers 464 of the respective process units 430K-430C, and upper roller 501 and lower roller 502, while being held in sandwiched relation. The page P(1) is advanced a predetermined distance (step S12), and then the write sensor 314 becomes OFF (step S13). If the paper sensor 313 and the write sensor 314 fail to detect the leading edge or the trailing edge of the page P(1), it is determined that an abnormal transportation of the page P(1) has occurred.

The main controller 601 makes a decision to determine whether a print command for page P(2) has been received (step S14). If it is determined at step S14 that the print command for page P(2) has not been issued, then the main controller 601 controls the paper feed motor controller 602 to stop the motor 607 (step S21). The page P(1) is further advanced and the discharge sensor 506 detects the trailing edge Pe(1) to output a sensor OFF signal (step S22).

The main controller 601 controls the ID motor controller 605 to stop the ID motor 610 (step S23), controls the belt motor controller 604 to stop the belt motor 609 (step S24), and controls the fixing motor controller 606 to stop the fixing motor 611 (step S25). This completes the operation.

If it is determined at step S14 that the print command for the page P(2) has been received, the main controller 601 sends a command to the paper feed motor controller 602 after the output of the write sensor 314 goes OFF (step S15), the paper feed motor controller 602 causing the paper feed motor 607 to rotate in the reverse direction (step S16), and causing the MPT roller 324 to rotate so that the MPT 320 advances the page P(2). When the paper sensor 313 detects the leading edge Ps(2) of the page P(2) (step S17), the MPT 320 transports the page P(2) a predetermined distance toward the nip formed between the friction member 316 and the driver roller 312 so that the leading edge Ps(2) advances further into the nip after the leading edge abuts the nip (step S18).

Therefore, the main controller 601 controls the paper feed motor controller 602 to stop the paper feed motor 607 (step S19). When the page P(1) has been transported over the distance L derived from Equation (1) after the write sensor 314 goes OFF at step 13, the main controller 601 controls the paper feed motor controller 602 to energize the paper feed motor 607, thereby repeating the operation from step S10 (step S20).

As described above, the distance between consecutive two pages is controlled to meet the relation given by Equation (1). A comparison image forming apparatus that does not employ the controls of the invention will be described. The comparison apparatus is of substantially the same configuration as the present invention.

In the present invention, control is made to maintain the interpage distance L between adjacent pages. In the comparison apparatus, the interpage distance is maintained to a distance $L_{ex}$ shorter than the distance L for increasing the throughput or printing speed of the image forming apparatus.

Shortly after the write sensor 314 detects the trailing edge Pe(n−1) of the page P(n−1), the write sensor 314 outputs a sensor OFF signal to the main controller 601, and the transport roller pair 310 stops.

Then, the MPT 320 advances the nth page P(n). After the paper sensor 313 has detected the leading edge Ps(n), the page P(n) is advanced a predetermined distance and then the MPT 320 stops. The page P(n) abuts the nip of the transport roller pair 310, thereby correcting the skew. Then, the page P(n−1) advances past the write sensor 314. The page P(n−1) further advances an interpage distance $L_{ex}$ after the output of the write sensor 314 goes OFF. Then, the transport roller pair 310 rotates to start transporting page P(n).

Once the page P(n) starts to be transported, the page P(n) is subjected to transportation and image formation just as in the page P(n−1).

Figure 5:
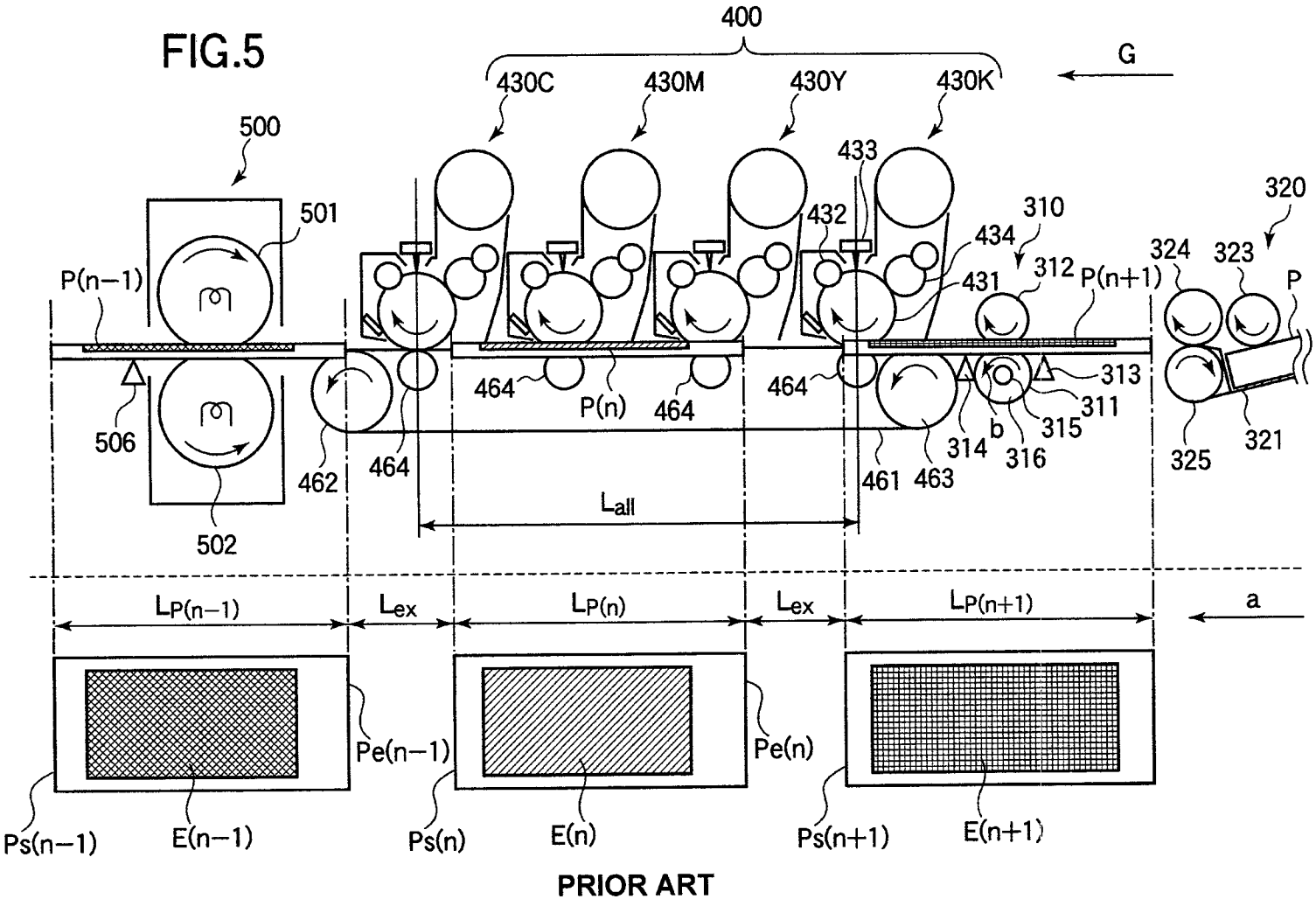
FIG. 5 illustrates the positions of pages when continuous printing is performed with a comparison image forming apparatus.

FIG. 5 illustrates the positions of pages when continuous printing is performed with the comparison image forming apparatus.

For continuous printing, pages are also transported such that page P(n−1) and page P(n) are spaced apart by the distance $L_{ex}$, and page P(n) and Page P(n+1) are spaced apart by the distance $L_{ex}$.

As described above, the comparison image forming apparatus performs continuous printing while maintaining the interpage distance to $L_{ex}$. This implies that more than one page may be present in a region shown by $L_{all}$ immediately downstream of the nip between the process unit 430K and the transfer roller 464. Thus, if continuous printing is performed on three pages, the printing on the second page may be affected by the first and third pages. This effect will be described with reference to FIGS. 6-14.

FIGS. 6-14 illustrate the positions of pages at different times when continuous printing is performed with the comparison image forming apparatus, and are aligned in the order of elapsed time.

References P1, P2, and P3 indicate the first page, second page, and third page. These pages have a basic weight of about 200 g/m$^2$ and a thickness of about 0.2 mm, which are highly recommended specifications for paper used in printers.

FIGS. 6-14 are simplified versions of FIG. 5. Referring to FIGS. 6-14, a nip 701 is formed between the rollers of the transport roller pair 310. Likewise, nips 702, 703, 704 and 705 are formed between the photoconductive drums 431 and the transfer rollers 464 at the respective process units 430K, 430Y, 430M, and 430C, respectively. A nip 706 is formed between the upper roller 501 and the lower roller 502 of the fixing section 500.

Figure 6:
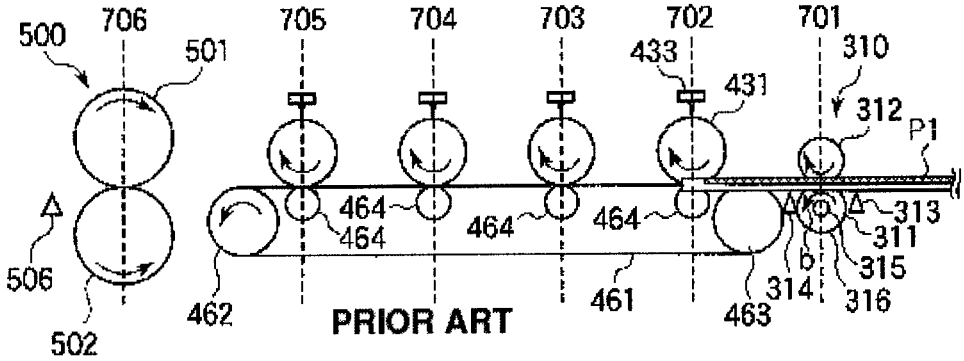
FIGS. 6-14 illustrate the positions of pages at different times when continuous printing is performed with the comparison image forming apparatus.

Referring to FIG. 6, the page P1 is advanced by the transport roller pair 310 and is fed into the nip 702 where the transfer roller 464 transfers a toner image onto the page P1. The page P1 is transported by the process unit 430K and the transport roller pair 310 until the trailing edge of the page P1 leaves the nip 702. Because the page P1 has a sufficient rigidity, the page P1 is transferred onto the transfer belt 461 without being deformed.

Figure 7:
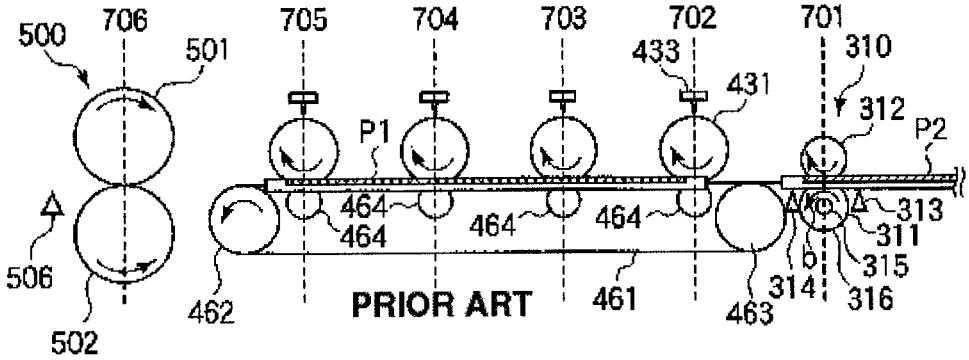
Figure 8:
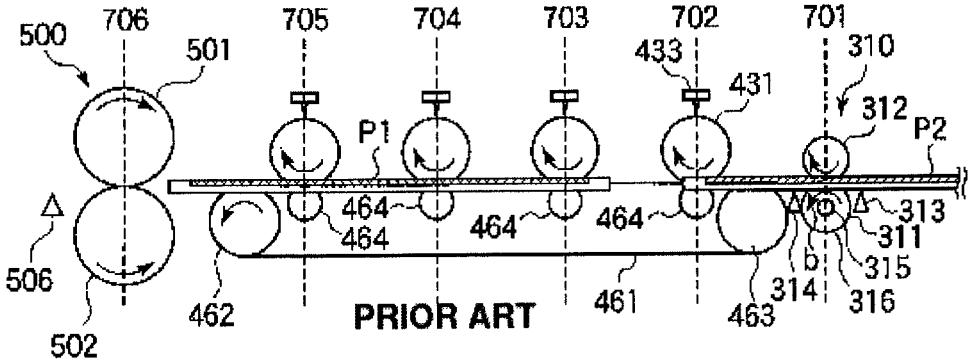

Then, the entire page P1 sits on the transfer belt 461 as shown in FIG. 7, and is transported only by the image forming section 400 at a constant speed.

Then, the page P2 is advanced from the nip 701 toward the nip 702 with an interpage distance $L_{ex}$ between the page P1 and the Page P2. As a result, two pages are present on the transfer belt 461 during image formation on the page P1. Because the page P2 has a sufficient rigidity, the page P2 is transferred onto the transfer belt 461 without being deformed. Then, the page P2 enters the nip 702. At this moment, the speed of the transfer belt 461 changes due to the entrance of the page P2 into the nip 702. This in turn causes a change in the transport speed of the page P1 downstream of the page P2. The change in the transport speed of the page P1 causes color shift of images printed on the page P1 at the nips 703, 704, and 705.

Figure 9:
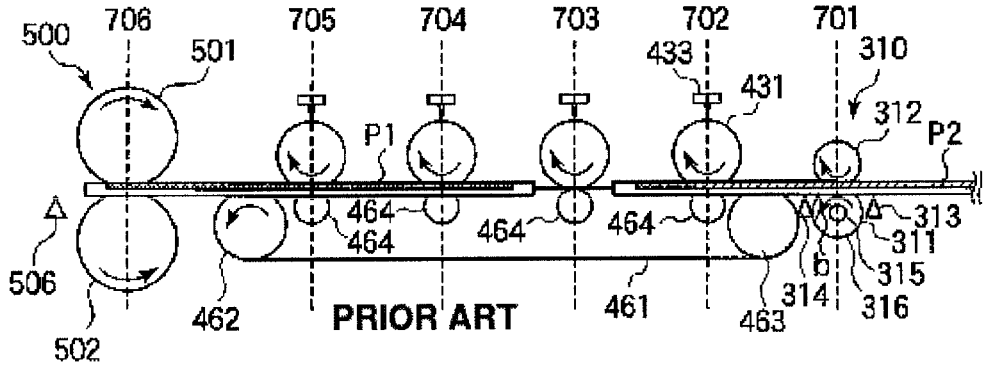
Figure 10:
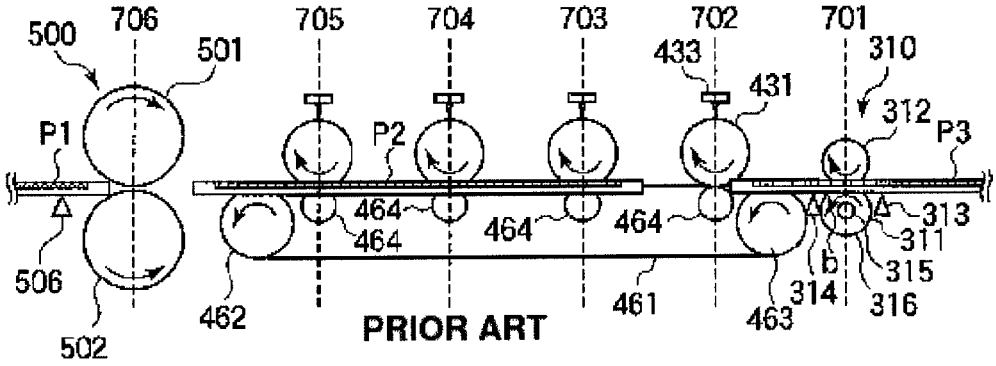

Referring to FIG. 9, the page P1 enters the nip 706 so that the fixing section 500 becomes a part of the paper transporting mechanism. For example, if the transport speed of the fixing section 500 becomes lower than the transfer belt 461 for some reason, the change in the transport speed of the fixing section 500 affects the transport speed of the transfer belt 461 via the page P1. This causes a change in the transport speed of the transfer belt 461, so that the transport speed of the page P2 also changes. As a result, the change in the transport speed of the page P2 causes color shift in the image printed on the page P2. The change in the transport speed of the fixing section 500 is greatly affected by changes in the temperature in the fixing section 500. A change in the temperature in the fixing section 500 causes changes in the outer diameters of the upper roller 501 and lower roller 502. A change in diameter causes a change in the circumferential speed of the rollers, which in turn causes a change in the transport speed of paper. The change in the transport speed of paper is a large factor that causes color shift. The factors that cause changes in the temperature in the fixing section 500 include the interior temperature of the image forming apparatus, measurement and mounting accuracies of a thermistor that detects the fixing temperature, the condition, width, length and thickness of the paper that absorbs heat, and the amount of toner deposited on the paper. Thus, it is difficult to maintain a constant temperature at the nip 706.

Figure 11:
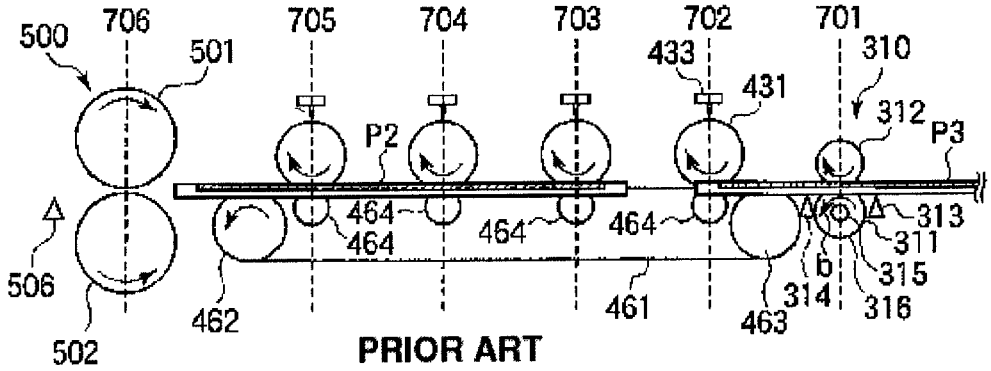
Figure 12:
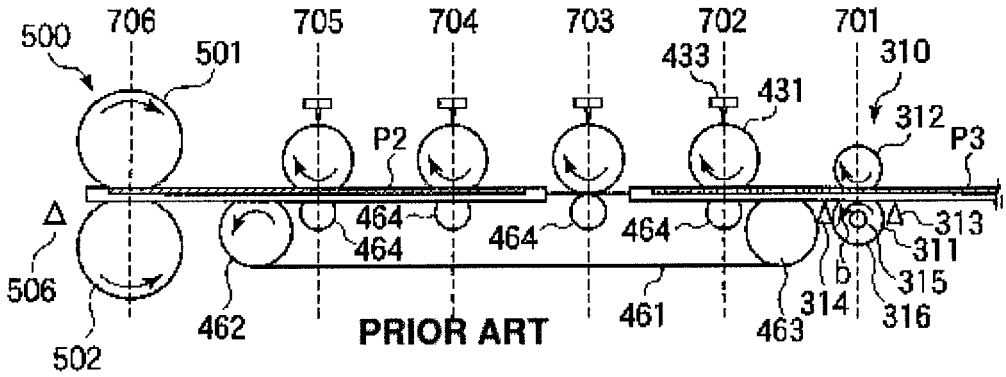
Figure 13:
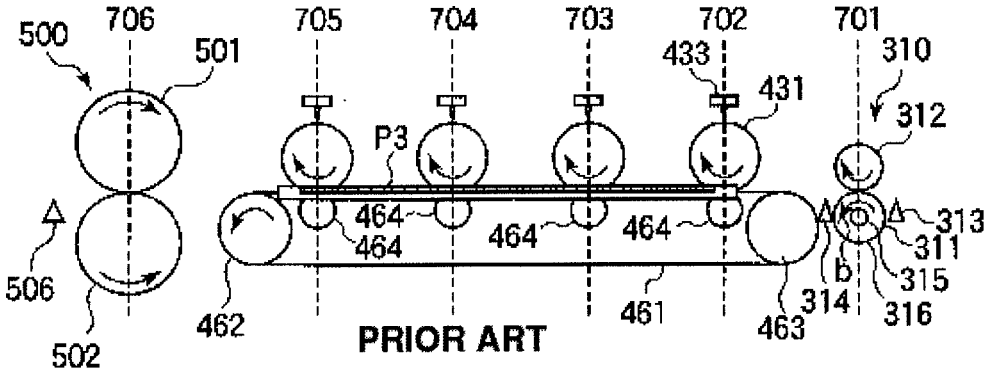
Figure 14:
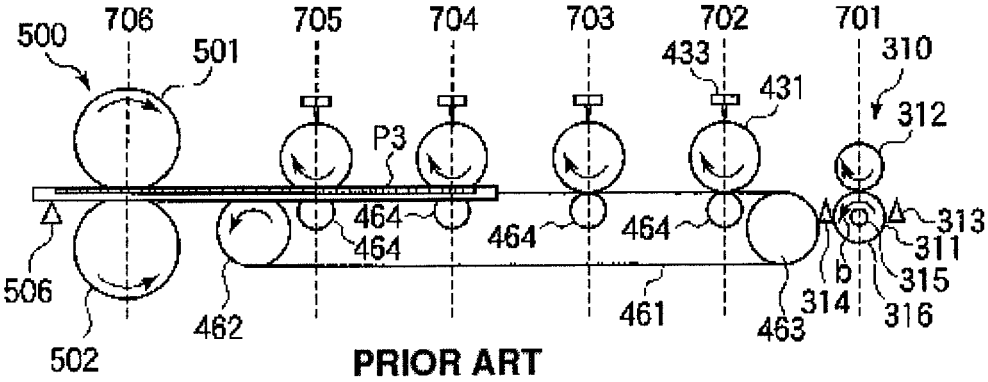

When the paper P1 has left the nip 705, the positional relation between the pages P2 and P3 (FIG. 10) is similar to that between the pages P1 and P2 shown in FIG. 7. Further, the positional relation between the pages P2 and P3 shown in FIGS. 11 and 12 is similar to that between the pages P1 and P2 shown in FIGS. 8 and 9. When the paper P2 has left the nip 705, the positional relation between the pages P2 and P3 (FIG. 13) is similar to that between the page P1 shown in FIG. 7. Finally, the page P3 is pulled into the nip 706 without a following page as shown in FIG. 13.

For printing on a single page, depending on which nips are contributing to the transportation of the page, the image processing may be corrected by, for example, reducing the size of image so that $L_D$ is longer than $L_{all}$. For continuous printing on a plurality of pages, changes in transport speed with time will occur in different portions of the paper transporting mechanism, and correction of image processing is difficult. If the paper is thick and rigid, the paper is difficult to flex and therefore changes in the transport speed at the respective nips are easily transmitted to other portions of the paper transporting mechanism. The tendency of color shift due to the change in transport speed is higher in the comparison image forming apparatus than in the image forming apparatus of the present invention.

For continuous printing on a plurality of pages, any pages after the first page are related such that a page is preceded by another page. This not only increases the chance of color shift occurring for the second page onward but also causes variations of color shift.

In the present invention, the controller 600 of the image forming apparatus controls the interpage distance to be the distance L derived from Equation (1). This ensures that an image area E(n) only of a single page is present in the area $L_{all}$ between the nip 702 and the nip 705 at any point of time during continuous printing. In other words, the print result of a page is affected neither by the immediately preceding page nor by the immediately following page. Further, the print result of a page is not affected by portions of the paper transporting mechanism that transports the immediately preceding page and/or immediately following page. This makes it possible to obtain stable, reliable transportation of the paper at all times, thereby preventing color shift in printed images.

The relation between the thickness of paper and color shift will be described. Thin paper having a basic weight equal to or less than 120 g/m may flex easily to alleviate the adverse effects due to the change in transport speed. Therefore, when continuous printing is performed with the interpage distance equal to $L_{ex}$ as in the comparison image forming apparatus, color shift is difficult to occur. Thick paper having a basic weight equal to or more than 163 g/m$^2$ is difficult to flex, causing a large color shift if continuous printing is performed with the interpage distance equal to $L_{ex}$. Therefore, if printing is performed on paper having a basic weight more than 163 g/m$^2$, which is larger than 120 g/m$^2$, the interpage distance is set to L obtained from Equation (1) for preventing color shift. The thickness of paper having a basic weight of 120 g/m$^2$ varies from type to type, ranging substantially from 0.110 mm to 0.130 mm. In other words, if paper having a thickness larger than 0.110 mm is used, the color shift may be effectively prevented by setting the interpage distance to L obtained from Equation (1).

The first embodiment has been described in terms of an image forming apparatus in which the user operates the operation panel 612 to set the basic weight and thickness of paper. The invention is not limited to this and the basic weight and thickness of paper may be set on a host apparatus side and the main controller 601 may receive the settings via the interface.

Figure 15:
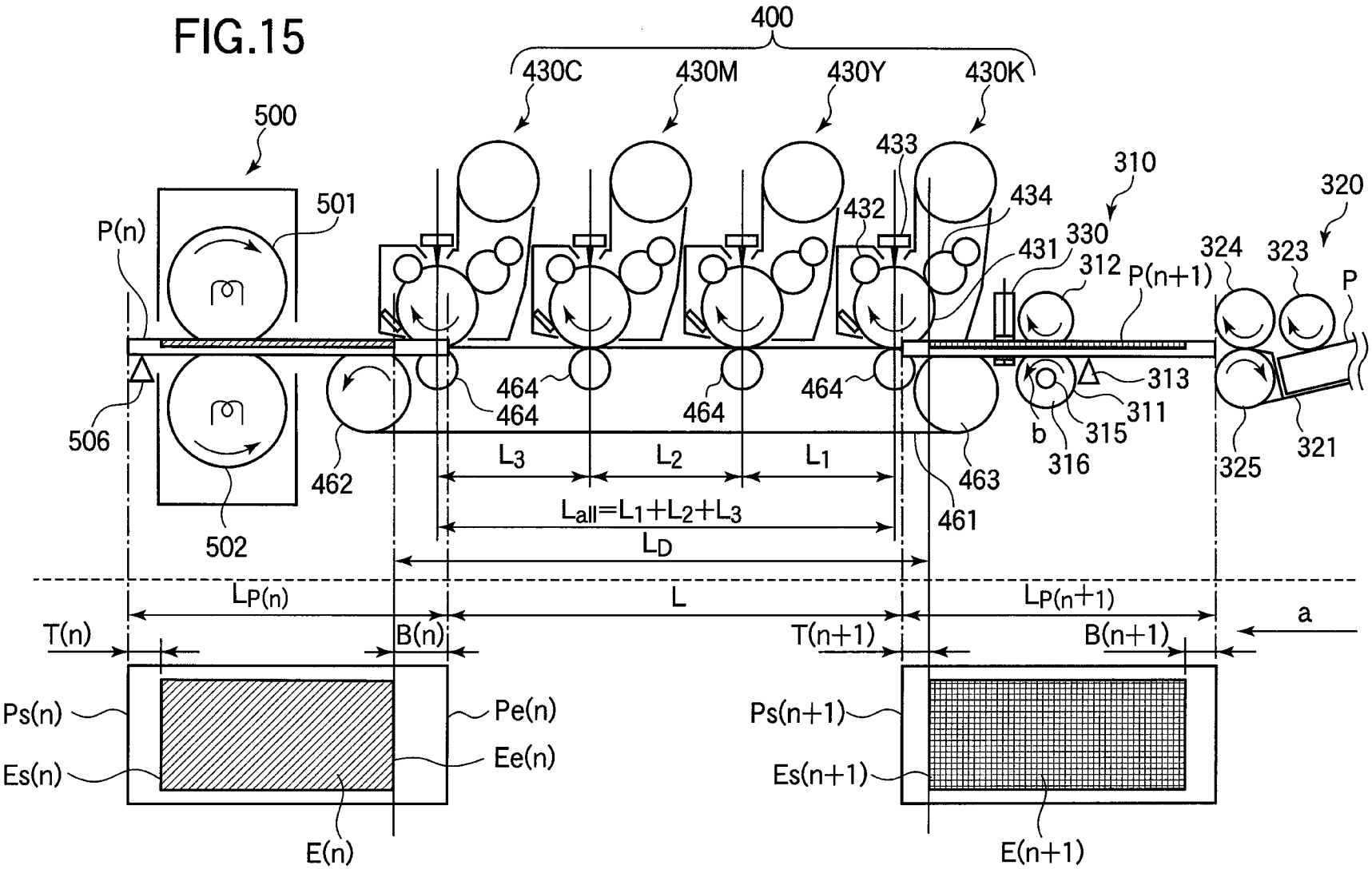
FIG. 15 illustrates the continuous printing operation of a modification to the image forming apparatus of the first embodiment.

FIG. 15 illustrates the continuous printing operation of a modification to the image forming apparatus of the first embodiment.

The write sensor 314 may be of the same type as a thickness sensor 330 shown in FIG. 15. The thickness sensor 330 may include a fixed stage, a movable lever such that the paper passes through a gap between the fist stage and the movable lever, and a spring that urges the movable lever against the fixed stage. The movable lever is movably urged against the fixed stage so that the paper pushed up the lever when the paper passes through the gap.

The paper passes the transporting roller pair 310 toward the image forming section 400. The paper enters a gap between the lever and the fixed stage to push up the movable lever, so that the amount of the upward movement of the movable lever is detected to determine the thickness of the paper. The data describing the thickness is sent to the main controller 601. If the thickness is greater than 0.110 mm, the main controller 601 performs control to maintain the interpage distance to L obtained from Equation (1).

As described above, continuous printing is performed with the interpage distance L obtained from Equation (1), i.e., the distance between the trailing edge of the image area of a preceding page of two consecutive pages and a leading edge of the image area of a following page is larger than the distance between the nip at the most upstream process unit and the nip at the most downstream process unit. Controlling the interpage distance in this manner reduces the chance of color shift occurring as compared to a conventional image forming apparatus. Thus, image forming apparatus of the first embodiment may be applicable to a variety of types of print medium including paper, OHP (transparency), and thick print medium. The advantages of the first embodiment are especially prominent for thick paper.

Second Embodiment

Figure 16:
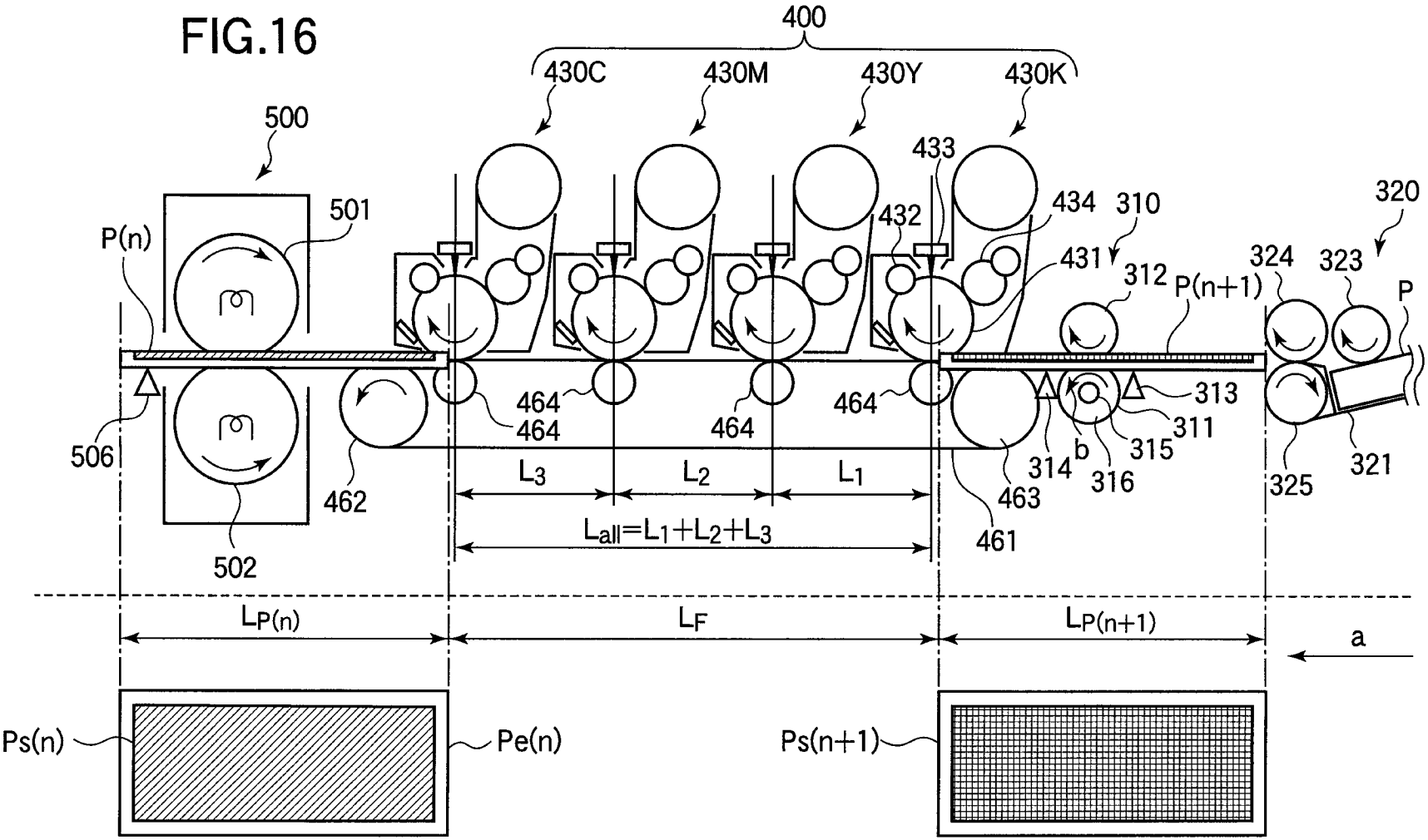
FIG. 16 illustrates an image forming apparatus of a second embodiment.

FIG. 16 illustrates an image forming apparatus of a second embodiment. The configuration of the image forming apparatus of the second embodiment is identical with that of the first embodiment, and differs only in interpage distance. Thus, the detailed description of the configuration of the image forming apparatus is omitted.

When continuous printing is performed on paper having a thickness larger than a predetermined thickness, the image forming apparatus is controlled to transport the pages with an interpage distance such that $L_F > L_{all}$, where $L_{all}$ is a distance between the nip at the most upstream process unit 430K and the nip at the most downstream process unit 430C. If thick paper having a basic weight equal to or more than 120 g/m$^2$ is used, the interpage distance $L_F$ is as follows:

$$L_F > L_{all} = L1 + L2 + L3$$

$$L_F > L1 + L2 + L3 \quad (2)$$

In other words, the interpage distance $L_F$ between the trailing edge Pe(n) of page P(n) and the leading edge Ps(n+1) of page P(n+1) is larger than the distance $L_{all}$.

Therefore, an image area only of a single page may be present in a region shown by the distance $L_{all}$ immediately downstream of the nip formed between the process unit 430K and the transfer section 460.

The control of the operation of the image forming apparatus will be described.

Figure 17:
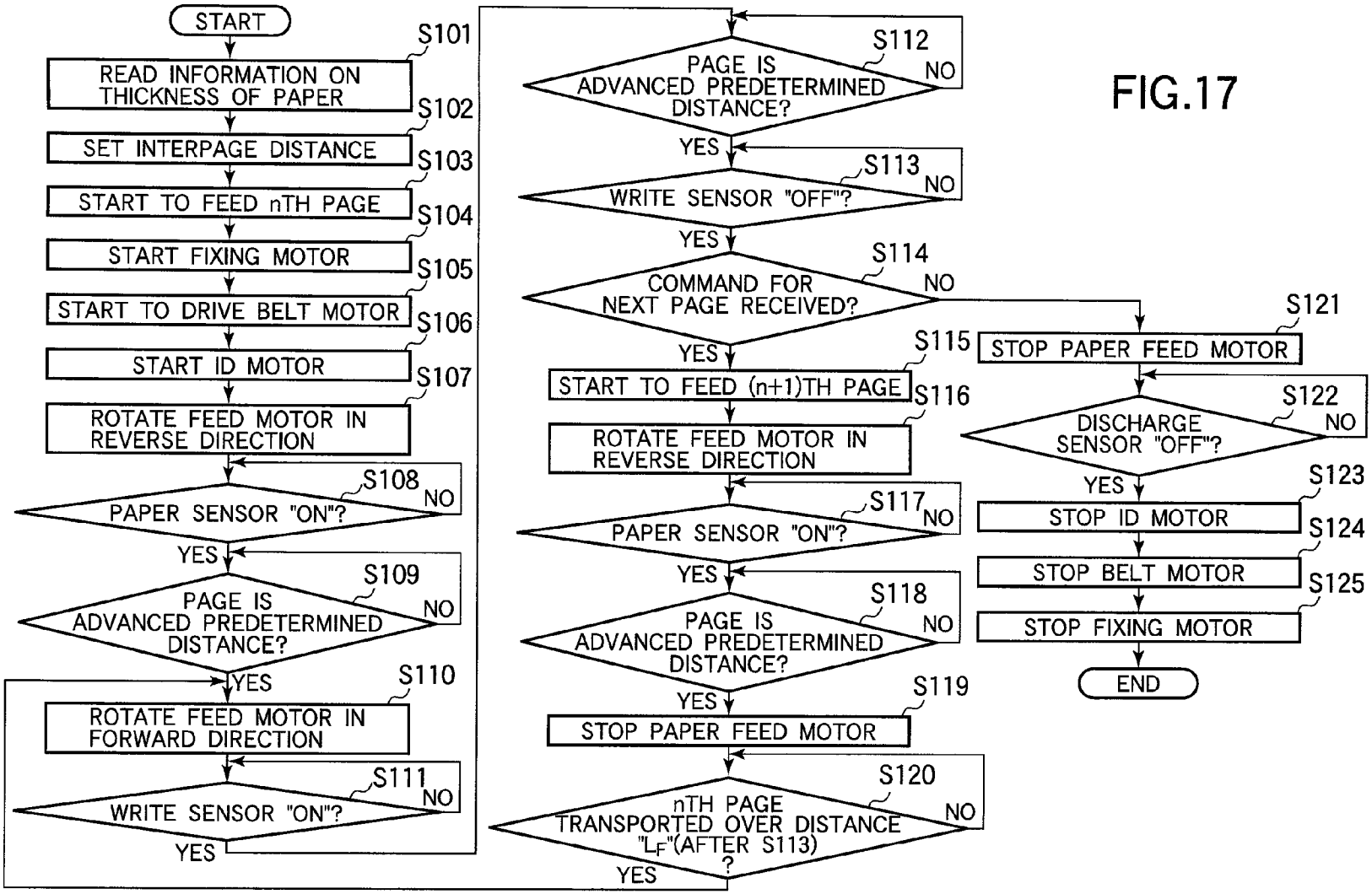
FIG. 17 is a flowchart illustrating the operation of the image forming apparatus shown in FIG. 16 when the paper is fed from the multi purpose tray.

FIG. 17 is a flowchart illustrating the operation when the paper is fed from the MPT 320. The operations from steps S101 to S119 are the same as those from steps S1 to S19 shown in FIG. 4, and therefore their description is omitted.

At step S119, the main controller 601 controls the paper feed motor controller 602 to stop the paper feed motor 607. Thereafter, when the output of the write sensor 314 goes OFF at S113, the paper P(1) has been transported over the distance $L_F$. Then, the main controller 601 controls the paper feed motor controller 602 to drive the paper feed motor 607 into rotation, and repeats the control from steps S110-S120. The operations at steps S121-S125 are the same as those at steps S21-S25 shown in FIG. 4.

As described above, the controller 600 controls the transportation of the paper to maintain the interpage distance $L_F$ obtained from Equation (2). Thus, only a single page may be present in a region shown by $L_{all}$ immediately downstream of the nip between the process unit 430K and the transfer section 460. Thus, the print result of a page is affected neither by the immediately preceding page nor by the immediately following page. Further, the print result of a page is not affected by any portion of the paper transporting mechanism that transports the immediately preceding page and/or immediately following page. This makes it possible to always obtain stable, reliable transportation of the paper, thereby preventing color shift from occurring.

It is to be noted that the interpage distance is longer in the second embodiment than in the first embodiment. This prevents changes in transport speed when the leading edge of page abuts the nip formed between the process unit 430K and the transfer section 460 and when the trailing edge of the preceding page leaves the nip between the process unit 430C and the transfer section 460.

In the second embodiment, when the leading edge of a page enters the nip formed between the process unit 430K and the transfer section 460, the trailing edge of the preceding page is not present at the nip of the most downstream process unit 430C. Therefore, the top of the images will appear at the same position on the respective pages.

Figure 18:
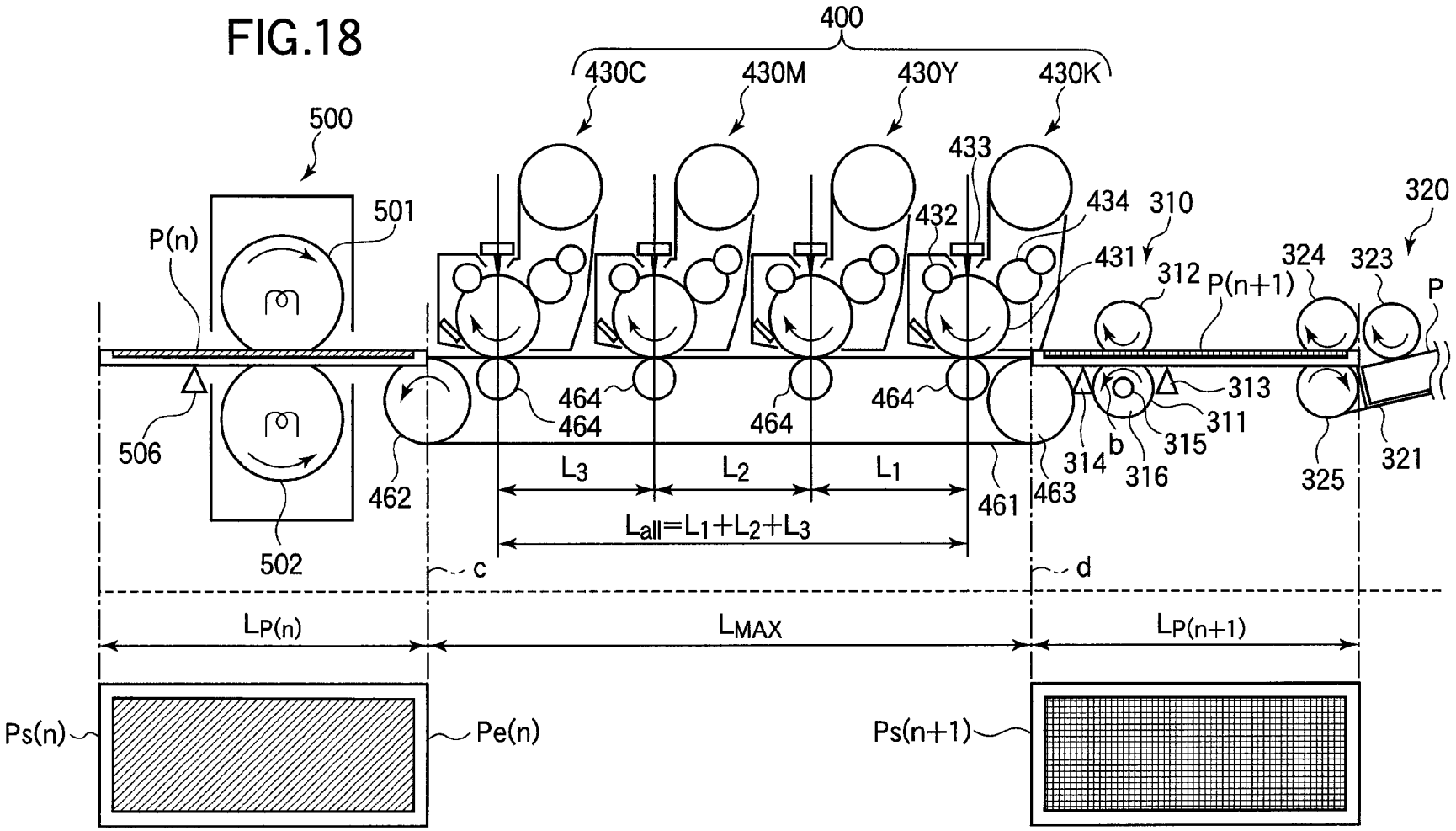
FIG. 18 illustrates a maximum tolerable interpage distance.

FIG. 18 illustrates a maximum tolerable interpage distance. As described in the first and second embodiments, color shift may be prevented by setting an interpage distance that meets Equation (1) or Equation (2). A maximum interpage distance $L_{MAX}$ is preferably a distance from position d where the transfer belt 461 is tangent to the drive roller 462 and the leading edge of the page is on the transfer belt 461 to position c where the transfer belt 461 is tangent to the tension roller 463 and the trailing edge of the page leaves the belt 461. In other words, the maximum interpage distance $L_{MAX}$ is preferably the distance between the axes of the drive roller 462 and tension roller 463. Thus, it is preferable that the controller 600 controls the transportation of the paper such that $L1+L2+L3-\{B(n)+T(n+1)\} < L < L_{MAX}$ where L is the interpage distance in the first embodiment and $L_{MAX}$ is the interpage distance in the second embodiment.

While the first and second embodiments have been described in terms of a case in which the MPT roller 324 of the MPT 320 transports the paper, the present invention is not limited to this. The same advantages may be obtained by employing the paper tray 100 or an optional paper tray (not shown) that may feed the paper in a different way. While the present invention employs a planetary gear for switching the transporting mechanism to be driven, the present invention is not limited to the planetary gear. Instead, an electromagnetic clutch may be employed as a switching mechanism if the transporting mechanism may be powered by an independent drive source.

Thus, image forming apparatus of the second embodiment may be applicable to a variety of types of print media including paper, OHP (transparency), and thick print medium. The advantages of the second embodiment are especially prominent for thick paper.

While the write sensor is used for detecting the paper, another type of paper sensor or a means that detects timing for feeding the paper may be used. The image forming section of the invention includes four process units for black, yellow, magenta, and cyan toner images. However, any number of process units or colors and any method of forming images may be used. The present invention may be applicable to copying machines and automatic document reading apparatuses.

What is claimed is:

1. An image forming apparatus, comprising:

a plurality of image forming sections;

a plurality of transfer sections;

a belt disposed between the plurality of image forming sections and the plurality of transfer sections in a sandwiched relation such that a nip is formed between one of the plurality of transfer sections and a corresponding one of the plurality of image forming sections;

a first rotatable member and a second rotatable member about which the belt is disposed; and a controller that controls transportation of at least one page of recording medium, wherein if a plurality of pages of recording media of a predetermined type are transported, control is performed such that a first distance between a trailing edge of an image area of a preceding page of two successive pages and a leading edge of an image area of a following page is equal to or longer than a second distance between the nip at a most upstream one of the plurality of image forming sections and the nip at a most downstream one of the plurality of image forming sections, and is equal to or shorter than a third distance between a rotational axis of the first rotatable member and a rotational axis of the second rotatable member, wherein the belt carries the at least one page of recording medium thereon and transports the at least one page of recording medium; and wherein the plurality of image forming sections and the plurality of transfer sections are aligned along the belt, and cooperate with each other to form images on the at least one page of recording medium.

2. The image forming apparatus according to claim 1, wherein the recording medium of the predetermined type is a transparency.

3. The image forming apparatus according to claim 1 further comprising an interface through which a user inputs a type of the recording medium.

4. The image forming apparatus according to claim 1 further comprising a thickness detection section disposed upstream of the nip of the most upstream one of the plurality of image forming sections, the thickness detection section detecting a thickness of the recording medium.

5. The image forming apparatus according to claim 1, wherein the recording medium of the predetermined type is a recording medium having a thickness greater than a reference value.

6. The image forming apparatus according to claim 5, wherein if the recording medium has a thickness smaller than the reference value, control is performed such that the first distance is shorter than the second distance.

7. The image forming apparatus according to claim 5, wherein if the recording medium has a basic weight equal to or less than 120 $g/m^2$, control is performed such that the first distance is shorter than the second distance.

8. The image forming apparatus according to claim 5, wherein if the recording medium has a basic weight equal to or more than 163 $g/m^2$, control is performed such that the first distance is longer than the second distance.

9. The image forming apparatus according to claim 5 further comprising an interface through which a user inputs a thickness of the recording medium.

10. The image forming apparatus according to claim 5 further comprising a thickness detection section disposed upstream of the nip of the most upstream one of the plurality of image forming sections, the thickness detection section detecting a thickness of the recording medium.

11. An image forming apparatus, comprising:

a plurality of image forming sections;

a plurality of transfer sections;

a belt disposed between the plurality of image forming sections and the plurality of transfer sections in a sandwiched relation such that a nip is formed between one of the plurality of transfer sections and a corresponding one of the plurality of image forming sections;

a first rotatable member and a second rotatable member about which the belt is disposed; and a controller that controls transportation of at least one page of recording medium, wherein if a plurality of pages of recording media of a predetermined type are transported, control is performed such that a first distance between a trailing edge of a preceding page of two successive pages and a leading edge of a following page is equal to or longer than a second distance between the nip at a most upstream one of the plurality of image forming sections and the nip at a most downstream one of the plurality of image forming sections, and is equal to or shorter than a third distance between a rotational axis of the first rotatable member and a rotational axis of the second rotatable member, wherein the belt carries the at least one page of recording medium thereon and transports the at least one page of recording medium; and wherein the plurality of image forming sections and the plurality of transfer sections are aligned along the belt, and cooperate with each other to form images on the at least one page of recording medium.

12. The image forming apparatus according to claim 11, wherein the recording medium of the predetermined type is a transparency.

13. The image forming apparatus according to claim 11 further comprising an interface through which a user inputs a type of the recording medium.

14. The image forming apparatus according to claim 11 further comprising a thickness detection section disposed upstream of the nip of the most upstream one of the plurality of image forming sections, the thickness detection section detecting a thickness of the recording medium.

15. The image forming apparatus according to claim 11, wherein the recording medium of the predetermined type is a recording medium having a thickness greater than a reference value.

16. The image forming apparatus according to claim 15, wherein if the recording medium has a thickness smaller than the reference value, control is performed such that the first distance is shorter than the second distance.

17. The image forming apparatus according to claim 15, wherein if the recording medium has a basic weight equal to or less than 120 $g/m^2$, control is performed such that the first distance is shorter than the second distance.

18. The image forming apparatus according to claim 15, wherein if the recording medium has a basic weight equal to or more than 163 $g/m^2$, control is performed such that the first distance is longer than the second distance.

19. The image forming apparatus according to claim 15 further comprising an interface through which a user inputs a thickness of the recording medium.

20. The image forming apparatus according to claim 15 further comprising a thickness detection section disposed upstream of the nip of the most upstream one of the plurality of image forming sections, the thickness detection section detecting a thickness of the recording medium.

* * * * *